US007677186B2

(12) United States Patent
Resta et al.

(10) Patent No.: US 7,677,186 B2
(45) Date of Patent: Mar. 16, 2010

(54) APPARATUS FOR MANUFACTURING MULTILAYER ARTICLES

(75) Inventors: Roberto Resta, Faenza (IT); Paolo Resta, Faenza (IT)

(73) Assignee: Resta S.R.L., Faenza (IT)

( * ) Notice: Subject to any disclaimer, the term of this patent is extended or adjusted under 35 U.S.C. 154(b) by 157 days.

(21) Appl. No.: 11/984,450

(22) Filed: Nov. 19, 2007

(65) Prior Publication Data

US 2008/0178785 A1 Jul. 31, 2008

(30) Foreign Application Priority Data

Jan. 31, 2007 (IT) ..... BO2007A0061

(51) Int. Cl.
*D05B 11/00* (2006.01)
*D05B 1/08* (2006.01)

(52) U.S. Cl. ..... 112/2.1

(58) Field of Classification Search ..... 112/2, 112/2.1, 470.33, 303–307, 475.08
See application file for complete search history.

(56) References Cited

U.S. PATENT DOCUMENTS 3,717,150 A * 2/1973 Schwartz ..... 604/372
4,077,340 A * 3/1978 Braun et al. ..... 112/131
4,399,763 A * 8/1983 Alexander ..... 112/475.07
5,236,769 A * 8/1993 Paire ..... 428/196
5,400,729 A 3/1995 Bryant
6,272,684 B1 * 8/2001 Shih ..... 2/87
7,100,525 B1 9/2006 Price et al.

FOREIGN PATENT DOCUMENTS

EP 0 684 207 A 11/1995
WO WO 95/04852 A 2/1995

* cited by examiner

*Primary Examiner*—Ismael Izaguirre
(74) *Attorney, Agent, or Firm*—Modiano & Associati; Albert Josif; Daniel J. O'Byrne

(57) ABSTRACT

An apparatus for manufacturing multilayer articles, comprising a first feeder for feeding a band made of textile material, a punching device arranged downstream of the first feeder to form slots in the band, a second feeder for feeding a strip of textile material arranged downstream of the punching device to arrange the strip so as to cover the slots, a sewing apparatus arranged downstream of the second feeder to fix the strip onto the band so as to cover the slots and provide a multilayer article, and a traction assembly arranged downstream of the sewing apparatus to actuate the advancement of the article through the sewing apparatus toward a collection unit.

7 Claims, 9 Drawing Sheets

APPARATUS FOR MANUFACTURING MULTILAYER ARTICLES

The present invention relates to an apparatus for manufacturing multilayer articles made of textile material, particularly but not exclusively the perimetric bands of mattresses provided with ventilation slots. In the continuation of the description, the definition of "textile material" is understood to reference materials which can be subjected to quilting processes, such as fabrics, non-woven fabrics, felt, expanded synthetic materials, such as polyurethane foams and the like.

BACKGROUND OF THE INVENTION

As is known, mattresses comprise an upper multilayer sheet and a lower sheet, the edges of which are mutually connected by a perimetric band, forming the case of the mattress, in which an insert is accommodated which is constituted by a cage of cylindrical spiral springs or by a panel of expanded plastic material which has elastic properties.

To allow internal ventilation of the mattress, the perimetric band of the case is provided with slots.

European Patent Application No. 07114821.7 filed Aug. 23, 2007 in the name of this same Applicant discloses a band for the perimetric closure of mattresses in which a strip of breathable textile material is arranged so as to cover the ventilation slots.

SUMMARY OF THE INVENTION

The aim of the present invention is to provide an apparatus which allows to apply, by means of stitched seams, a strip onto a band which is aligned with it.

Within this aim, an object of the present invention is to provide an apparatus which allows to provide ventilation slots within the band and in alignment with said band and to apply, by means of stitched seams, a breathable textile strip to cover the ventilation slots.

Another object of the present invention is to provide an apparatus which allows to prepare continuously or intermittently a multilayer band provided with ventilation slots and to associate continuously or intermittently with said band, by means of stitched seams, a strip for covering the slots.

This aim and these and other objects which will become better apparent hereinafter are achieved with an apparatus for manufacturing multilayer articles, characterized in that it comprises first means for feeding a band made of textile material, a punching device which is arranged downstream of said first feeder means and is adapted to form slots in said band, second means for feeding a strip of textile material which are arranged downstream of said punching device and are adapted to arrange said strip so as to cover said slots, a sewing apparatus which is arranged downstream of said second means and is adapted to fix, by means of stitched seams, said strip onto said band so as to cover said slots, so as to provide a multilayer article, and a traction assembly which is arranged downstream of said sewing apparatus in order to actuate the advancement of said article through said sewing apparatus toward a collection unit.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
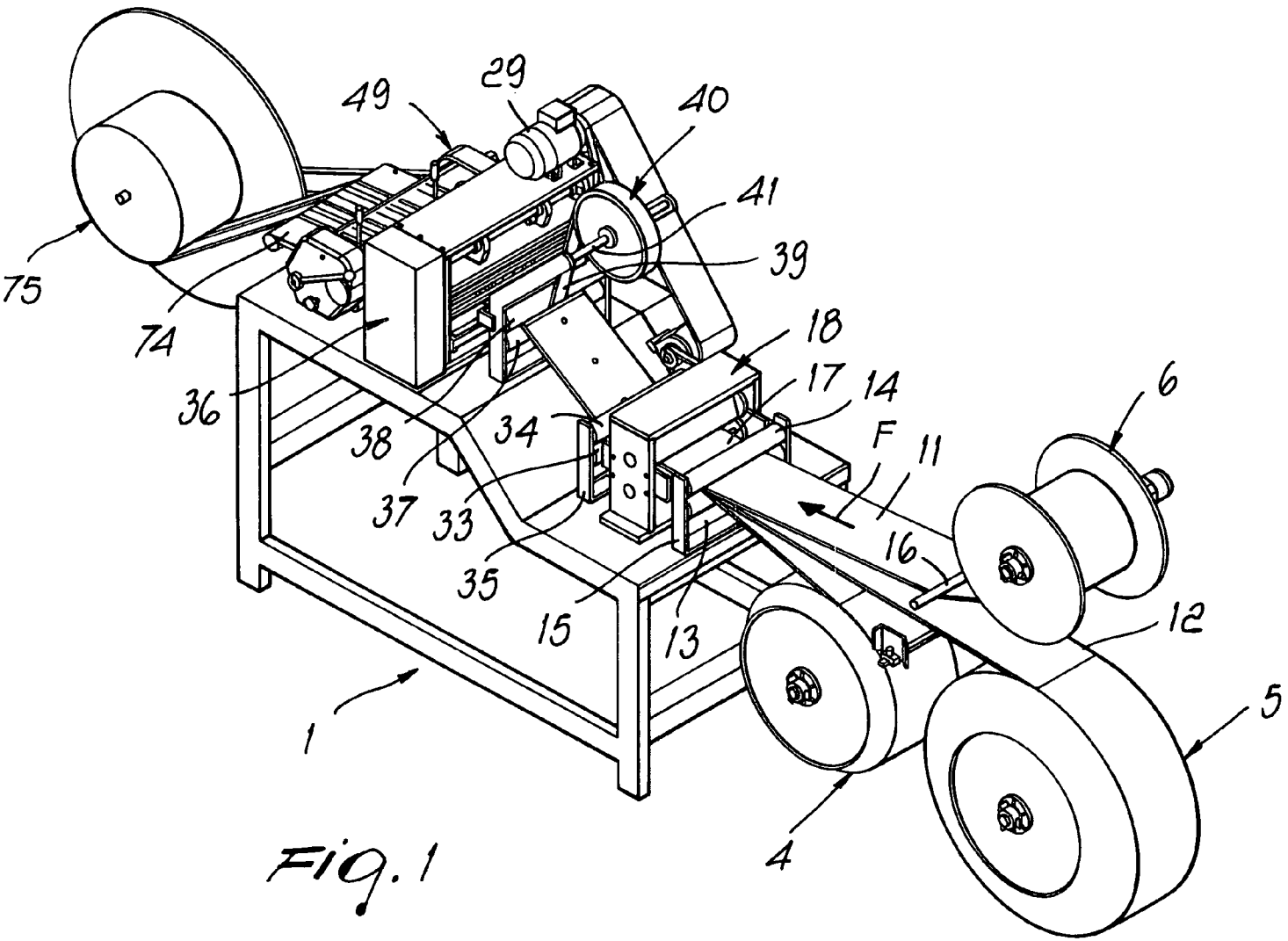
FIG. 1 is a perspective view of an apparatus according to the invention.
Figure 2:
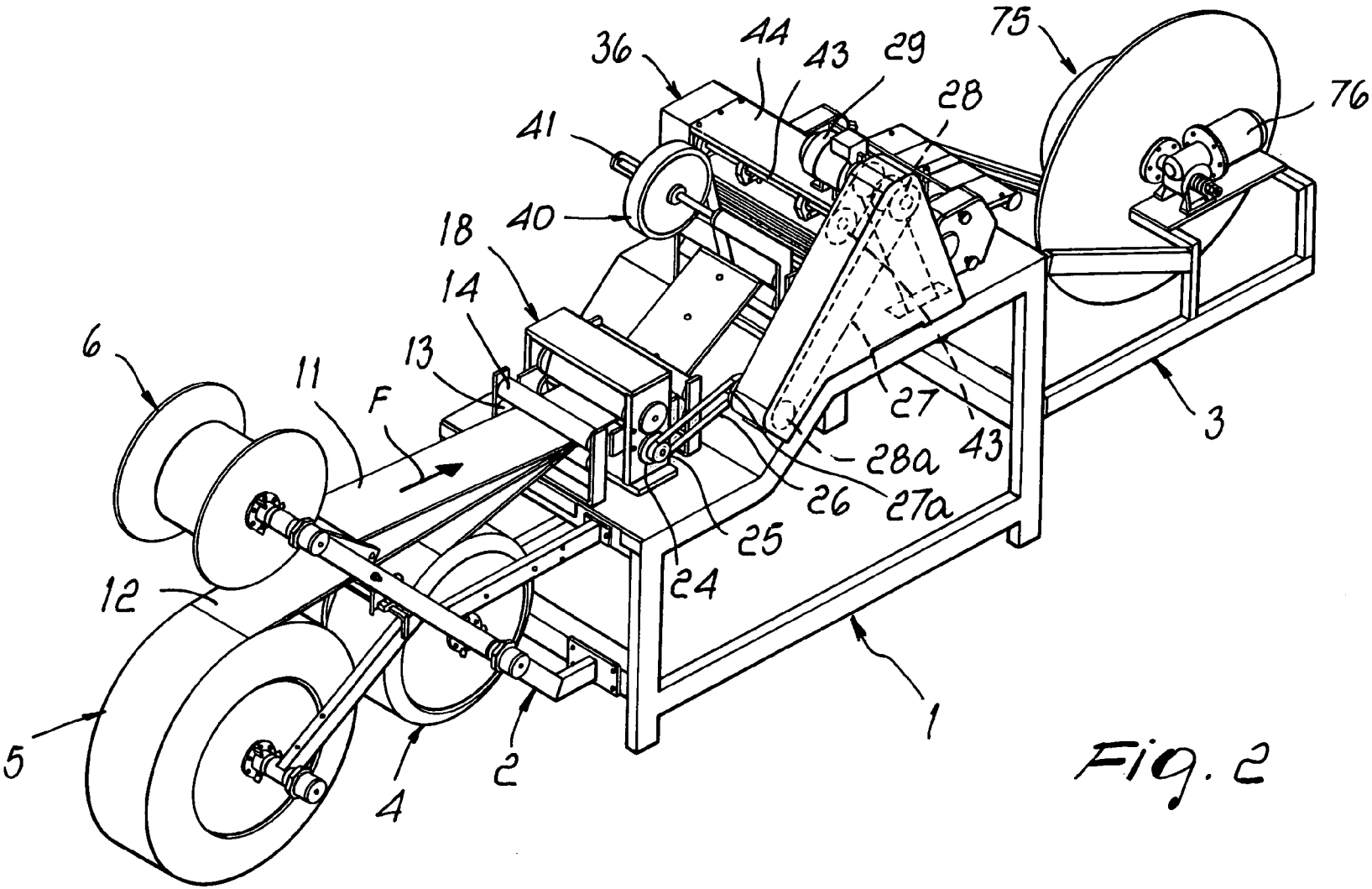
FIG. 2 is a perspective view of the apparatus, taken from the opposite side with respect to FIG. 1.

With reference to FIGS. 1, 2, 3 and 4, the apparatus is composed of a main frame, generally designated by the reference numeral 1, upstream and downstream of which, with respect to the advancements direction F of the band and of the strip which co-operate to form the final article, respective brackets 2, 3 protrude.

Figure 3:
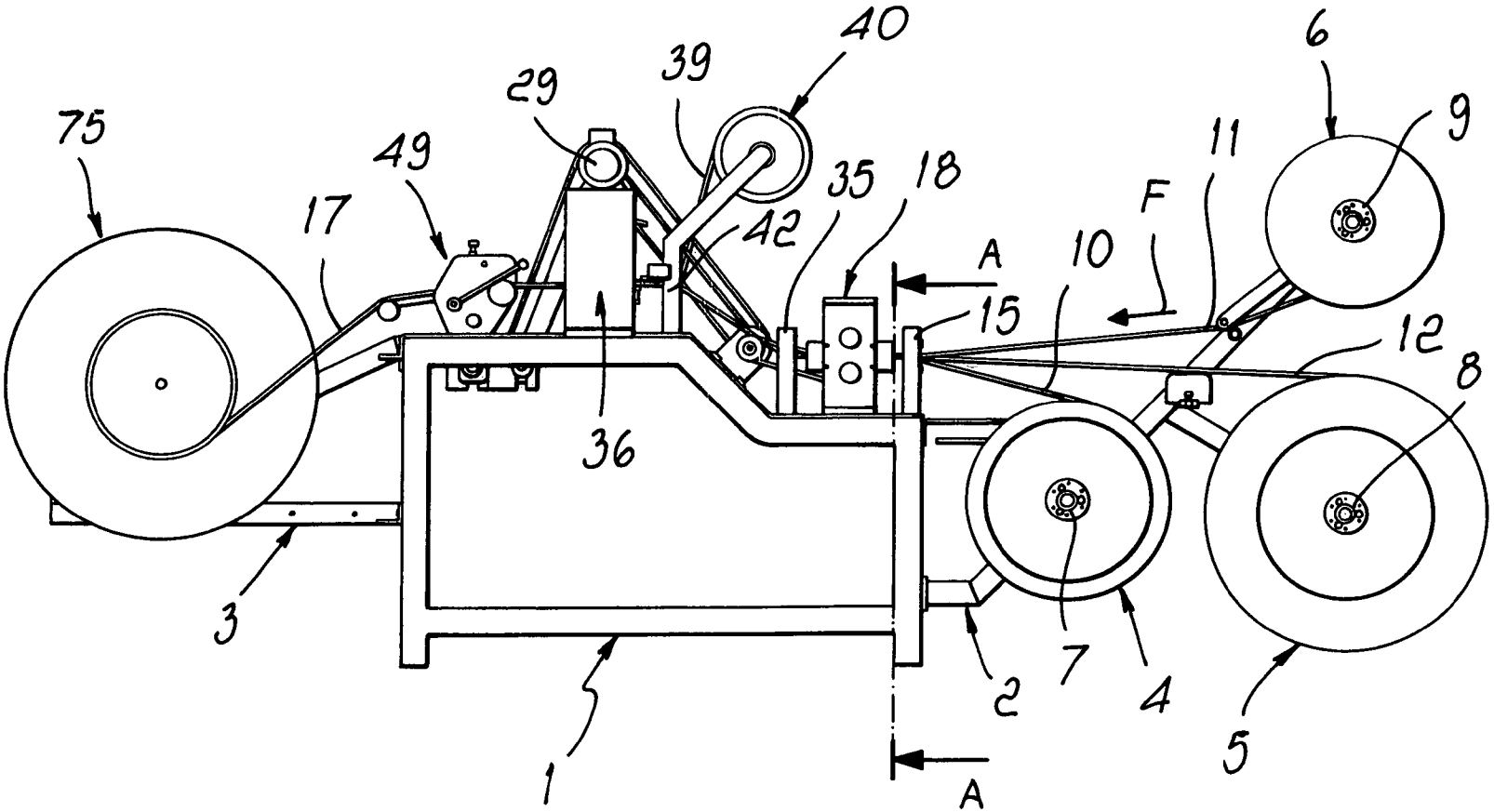
FIG. 3 is a side view of the apparatus.
Figure 4:
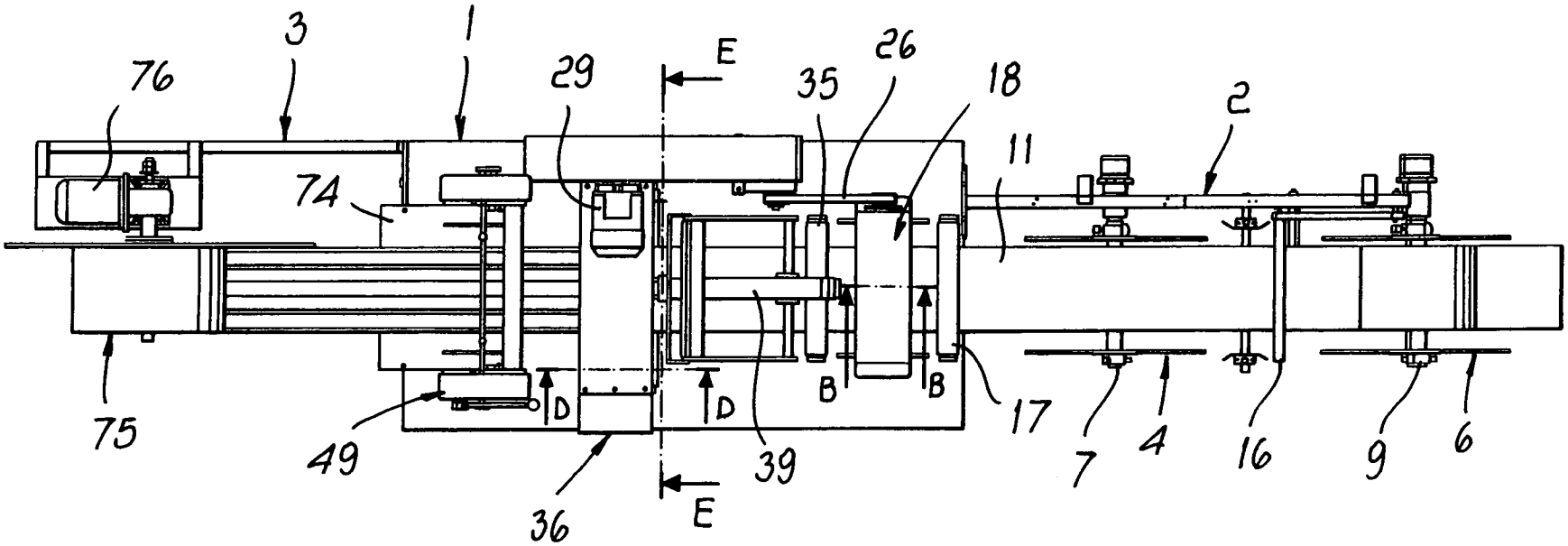
FIG. 4 is a plan view of the apparatus of FIGS. 1 and 2.

The bracket 2 supports three reels 4, 5, 6, which are mounted so that they can rotate on respective shafts 7, 8, 9 and protrude in a cantilever fashion from the bracket 2. Two ribbon-like fabrics 10, 11 are wound around the reels 4, 6, whereas an intermediate insert 12 is wound onto the intermediate reel 5 and is constituted for example by a tape made of flexible expanded plastic material (FIG. 3). The two fabrics 10, 11 and the insert 12 are unwound in the feeding direction F from the respective reels 4-6 and are conveyed between a pair of parallel rollers 13, 14, which are mounted so that they can rotate on a secondary frame 15 which is fixed to the main frame 1. Conveniently, tensioning rollers 16 act on the fabrics 10, 11 in order to maintain the correct tension.

Figure 6:
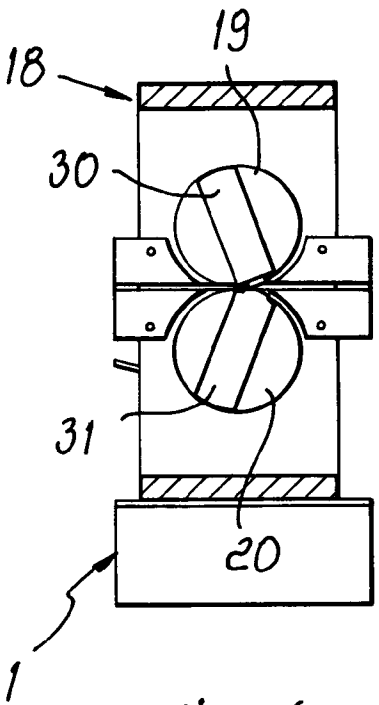
FIG. 6 is a sectional view, taken along the plane B-B of FIG. 4.
Figure 5:
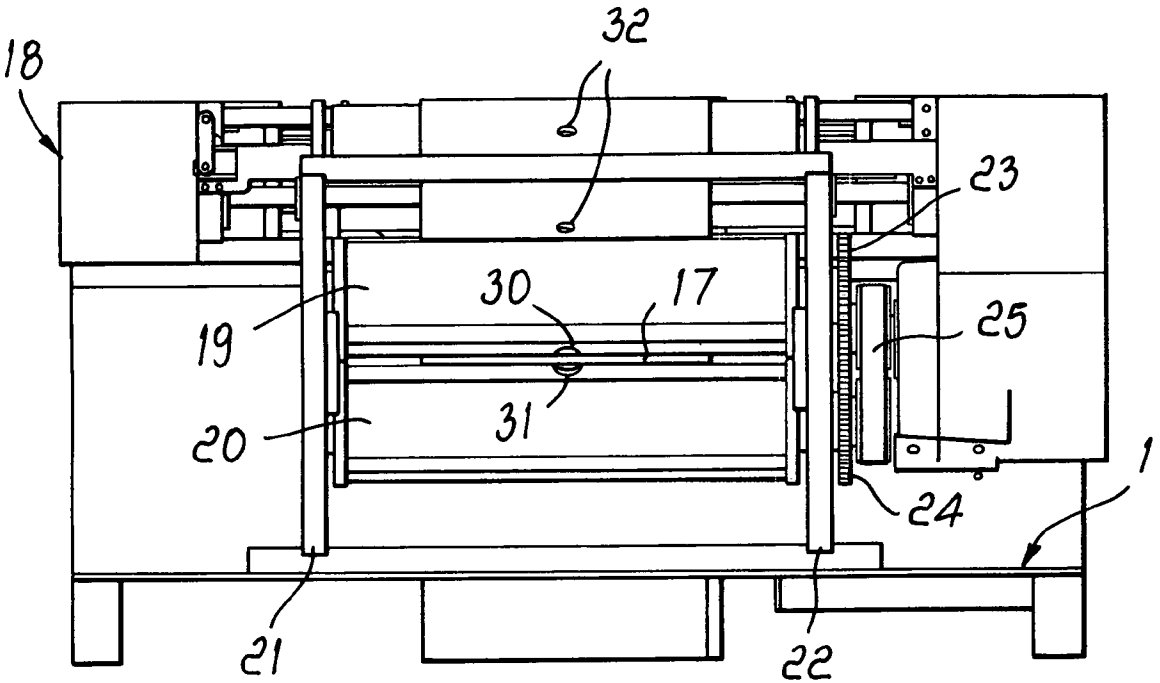
FIG. 5 is a sectional view, taken along the plane A-A of FIG. 3.

The fabrics 10, 11 and the insert 12 have the same width, so that at the output from the rollers 13, 14 they form a single three-layer tape which is referenced hereinafter, for the sake of convenience in description, as the band 17. The band 17 is then guided through a punching device, generally designated by the reference numeral 18 and shown in greater detail in FIGS. 5 and 6.

The punching device 18 is composed of a pair of mutually parallel and superimposed rollers 19, 20, which are supported so that they can rotate in two side walls 21, 22 which rise from the main frame 1. The rollers 19, 20 are provided with pivots which pass through the side wall 22 and on which a gear is keyed which is composed of a pair of sprockets 23, 24 which have the same diameter and mesh together.

A pulley 25 is also keyed onto the same pivot onto which the lower sprocket 24 is keyed, and a transmission belt 26 is wound onto said pulley and, by means of an additional belt 27, receives motion from a motor 29 which is coupled by means of a flange to the sewing machine 36 described below.

The belt 27 is closed in a loop on a pulley 28, which is keyed to the output shaft of the motor 29, and on a pulley 28*a*, which is keyed to an auxiliary shaft on which the pulley 27*a* for guiding the belt 26 is keyed.

By virtue of the gear system 23, 24, the rollers 19, 20 contrarotate with respect to each other so that the direction of rotation is F in the point of tangency.

The rollers 19, 20 have such a diameter as to define, in their point of tangency, a slit which is adapted to keep the strips 10, 11 in contact against the upper and lower faces of the intermediate insert 12, optionally applying adequate compression to the latter.

Two punches 30, 31 are arranged diametrically within the rollers 19, 20, in a central position thereof, and have respective ends which mutually cooperate so as to provide a sort of punching blade which is adapted to form slots 32 in the band 17 which is guided between the rollers. For this purpose, one end of a punch forms, as shown more clearly in FIG. 6, an annular blade which, along the arc of the rotation in which the punches are mutually opposite, engages a complementary blade which is formed at the end of the other punch, cutting through the band at each turn of the rollers and forming slots 32 which are equidistant along a central line of the band 17.

Downstream of the punching device 18 there are two additional rollers 33, 34, which can rotate within a secondary supporting frame 35 which is fixed to the main frame 1. The rollers 33, 34 are designed to divert the band 16 toward a sewing apparatus 36, upstream of which there is an interposed additional pair of rollers 37, 38 which are supported so that they can rotate within a secondary frame 42 and are designed to associate with the band 17 a strip 39 made of breathable textile material.

The strip 39 is taken from a reel 40, which can rotate on a shaft 41 which is supported at the ends of two angled arms which extend upward from the sides of the secondary frame 42 (FIG. 3) for supporting the rollers 37, 38.

Figure 8:
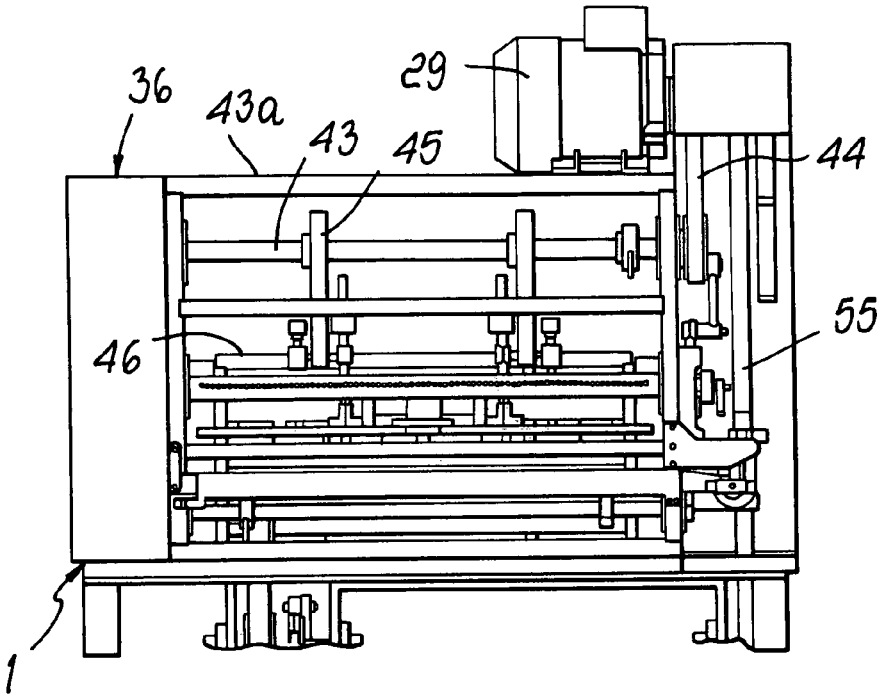
FIG. 8 is a sectional view, taken along the plane E-E of FIG. 4.
Figure 7:
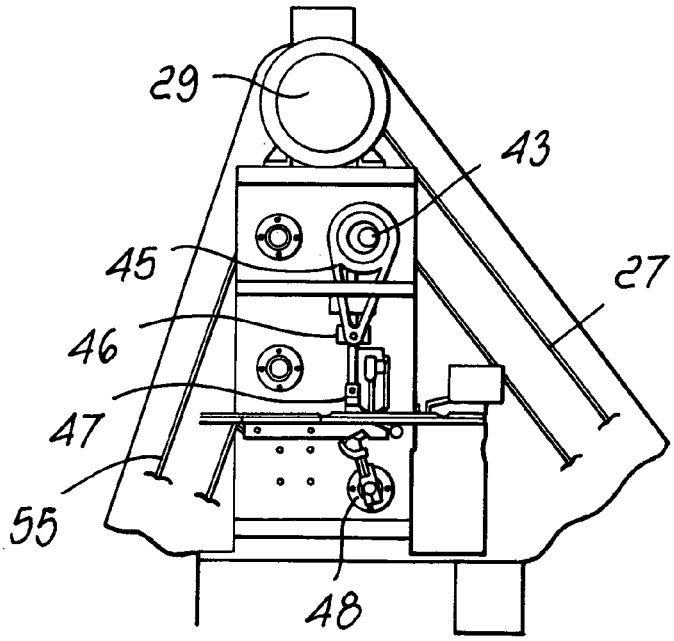
FIG. 7 is a sectional view, taken along the plane D-D of FIG. 4.

The sewing machine 36 (FIGS. 7, 8) has a traditional structure and comprises a camshaft 43, which is supported so that it can rotate within the side walls of a portal-shaped framework 43*a*, which is fixed to the frame 1 downstream of the sewing machine. The camshaft 43 is connected by a belt 44 to the same motor 29 that drives the belt 27, which by means of the other belt 26 actuates the punching device 18.

The camshaft 43, by means of a pair of linkages 45, imparts a reciprocating motion to the bar 46 which carries the sewing needles 47 which are functionally associated with the respective crochets 48.

Figure 13:
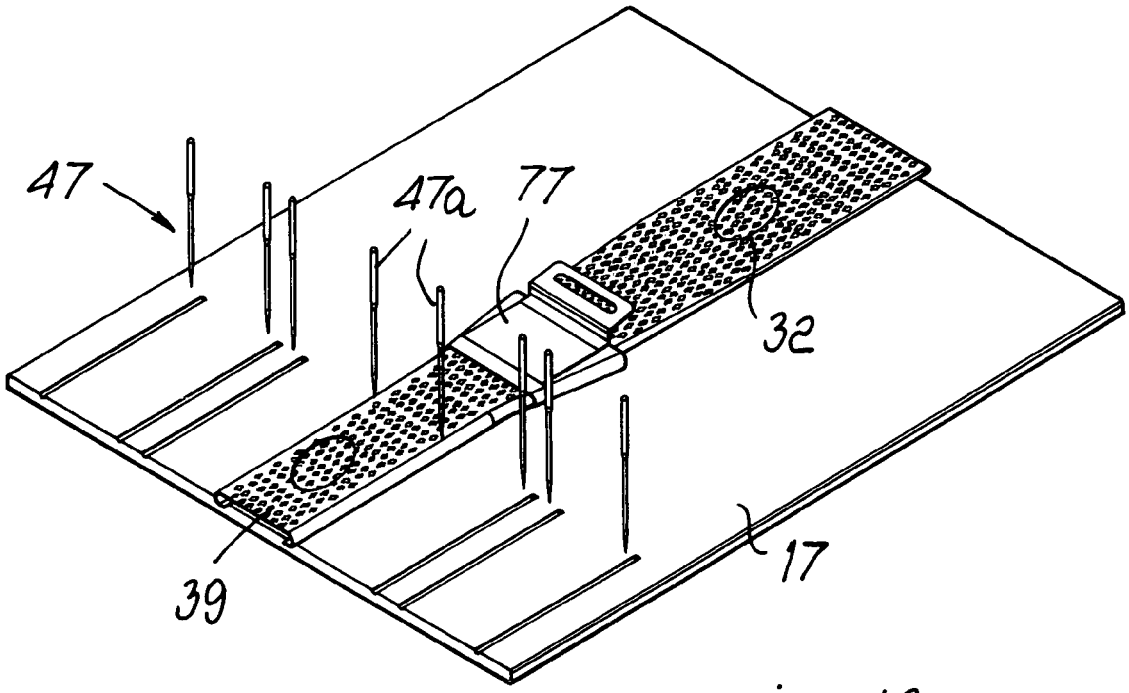
FIG. 13 is a perspective view of the region where the strip is applied to the band.

As shown more clearly in FIG. 13, in the described example there is a series of needles 47, of which the two central ones 47*a* fix the lateral edges of the strip 39 onto the central region of the band 17, so as to cover the slots 32, while the remaining needles continue to join together the fabrics 10, 11 and the insert 12 along the lateral regions with respect to the band 32.

The described apparatus further comprises a traction assembly, which is generally designated by the reference numeral 49 and is arranged downstream of the sewing machine 36 (FIGS. 9-12).

The traction assembly 49 is designed to grip the band 17 that abandons the sewing apparatus or machine 36 already provided with the strip 39 and to impart an intermittent advancement movement to the band 17.

The assembly 49 comprises a box-like body which has two side walls 50, 51, which are mutually connected by a cross-member 52 for fixing below the plane of the frame 1. The side walls 50, 51 support a shaft 53 whose opposite ends protrude outside the side walls. A pulley 54 is keyed onto one end and, by means of a belt 55, receives motion from the motor 29; an eccentric element 56 is keyed onto the other end.

A bracket 57 is externally rigidly coupled to the side wall 50 and together with said side wall supports a shaft 58 which is parallel to the shaft 53.

A pulley 59 and a bush 60 provided with a radial arm 61 which extends upward (FIG. 12) are keyed onto the shaft 58. The arm 61 is connected to the eccentric element 56 by a tension element 62 of adjustable length. A driving belt 63 is wound around the pulley 59 and is closed in a loop around an additional pulley 64, which is coupled rotatably, together with a second pulley 65 having a smaller diameter, to a pivot 66 which is supported rotatably on parts of the box-like body which are not shown in the drawing but can be deduced easily.

By means of a narrow belt 67, the pulley 65 transmits motion to a pulley 68 which is keyed onto a pivot 69 which extends axially from one end of a roller 70 which is supported rotatably within the body of the assembly 49 and has a knurled external surface.

Figure 9:
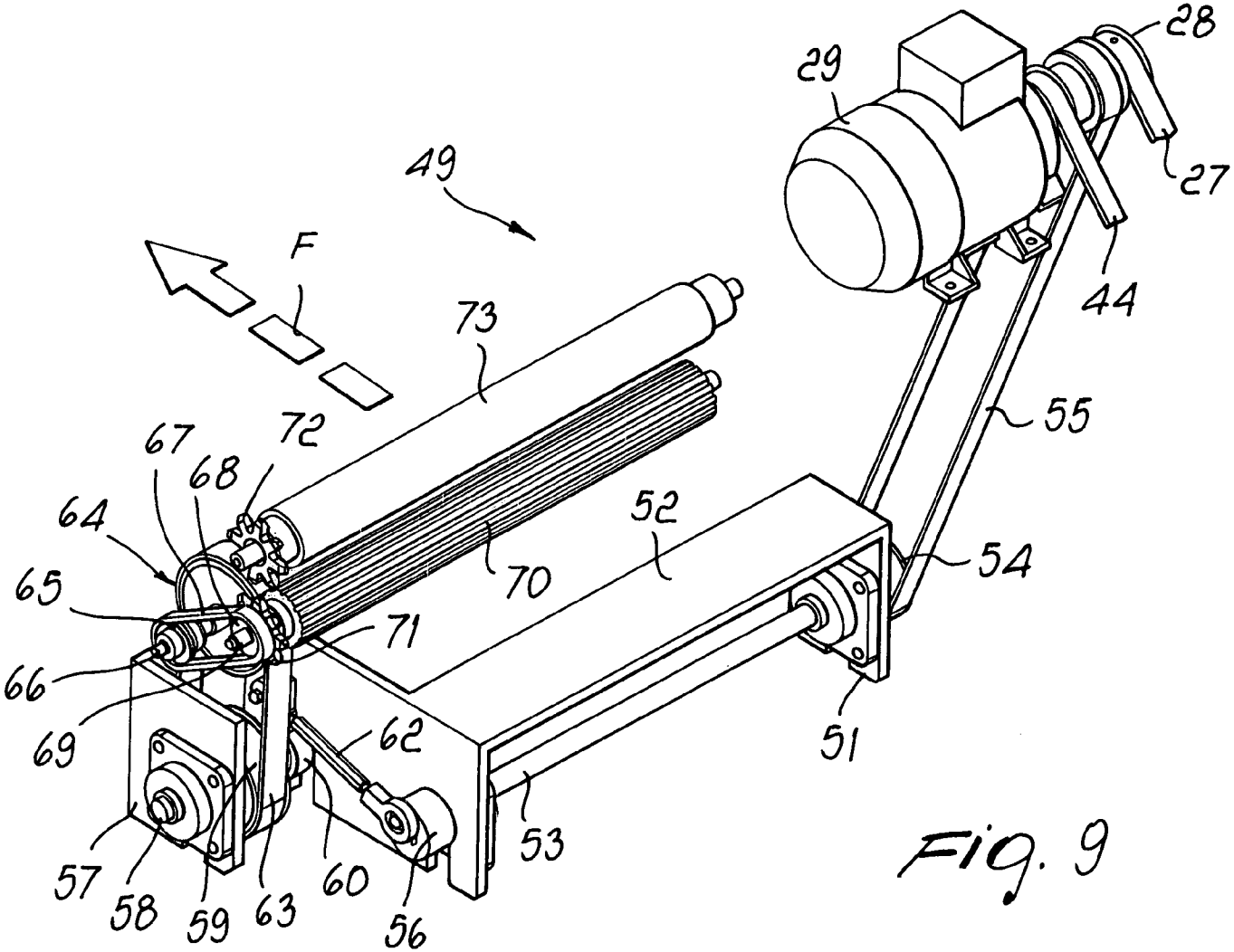
FIG. 9 is a perspective view of the traction assembly.
Figure 11:
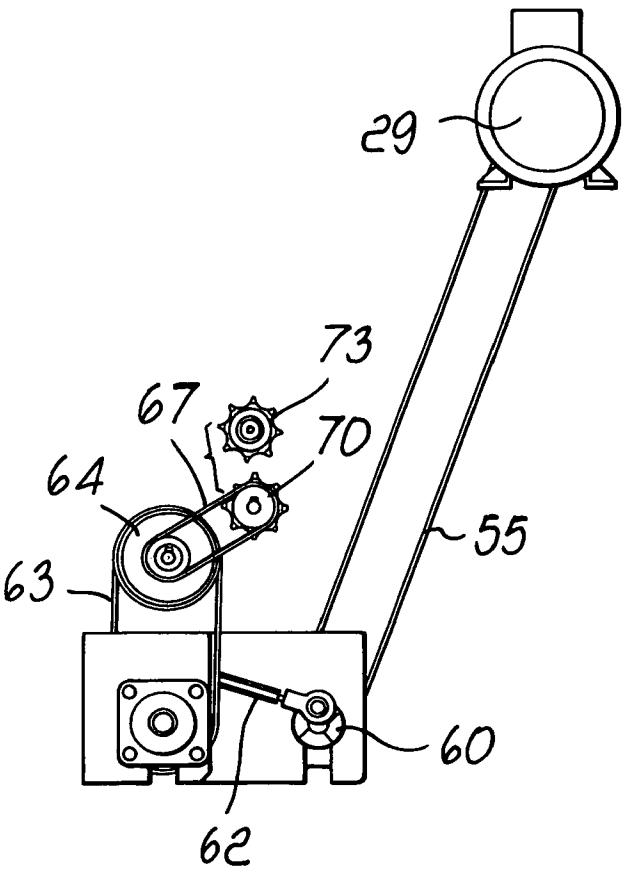
FIG. 11 is a side view of the assembly of FIG. 9.
Figure 10:
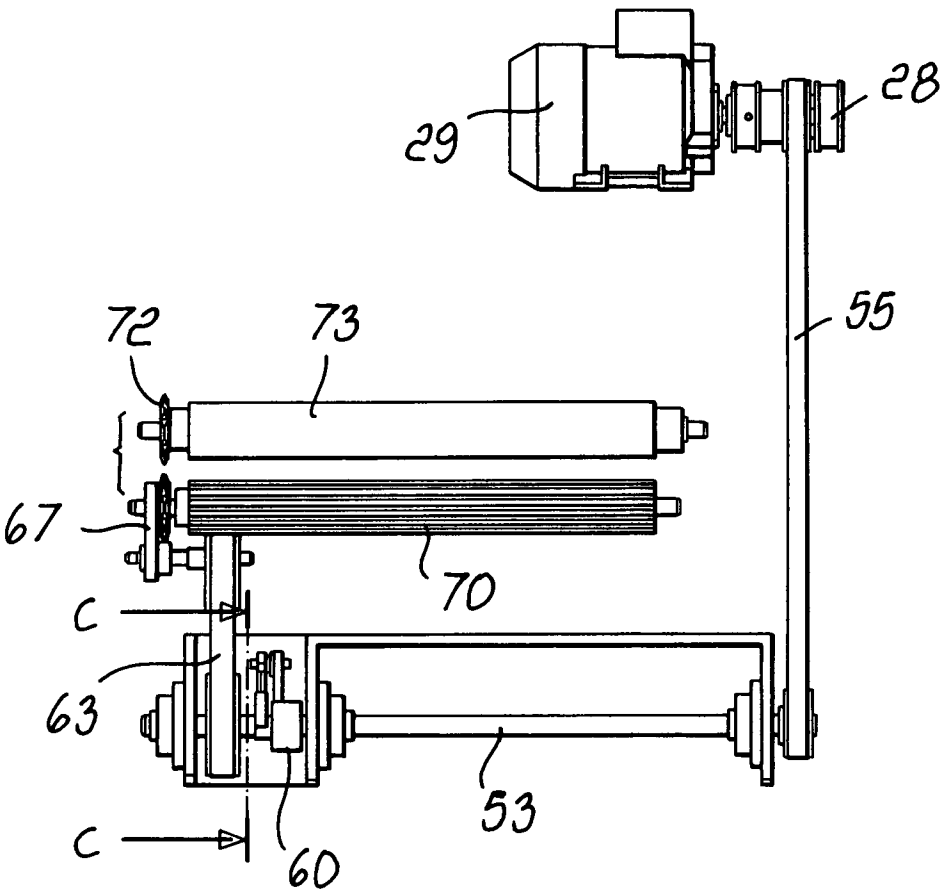
FIG. 10 is a front view of the assembly of FIG. 9.
Figure 12:
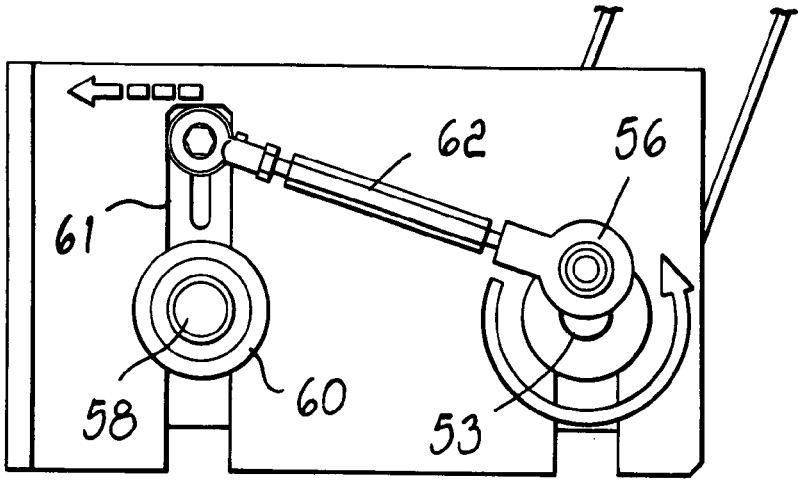
FIG. 12 is a sectional view, taken along the plane C-C of FIG. 10.

A first gear 71 is fixed rotationally to the pivot 70, to the side of the pulley 68, and a second gear 72 meshes therewith and is associated with a roller 73 which is parallel to the roller 70. In FIG. 9, the gears 71, 72 are shown mutually disengaged for the sake of clarity of the drawing.

To allow the intermittent advancement motion of the band 16 only in the direction F, a one-way joint or freewheel is incorporated into the bush 60 and allows to use the oscillation of the arm 61 only in the direction F.

It should be noted that the traction assembly 49 is synchronized with the sewing machine 36 so that the advancement movements of the band 17 produced by the rollers 70, 73 occur when the bar 46 of the needles is raised and therefore the needles 47 are disengaged from the band 17.

The described apparatus is completed by a sliding surface 74 which conveys the band 17 toward a takeup reel 75, which is mounted on the bracket 3 and actuated by a motor 76.

Although the operation of the apparatus can be deduced already from the above description, it occurs as follows.

The fabrics 10, 11 and 12, once they have been joined by the rollers 13, 14, form a band 17 which is punched inside the device 18.

After passing beyond the device 18, the band 17 passes through the sewing machine 36, where the strip 39 is joined so as to cover the slots 32.

Conveniently, as shown in FIG. 13, upstream of the needles 47 there is a tucking plate 77 which tucks under the strip 39 the lateral edges thereof, so as to ensure higher strength of the stitched seams.

Finally, the band thus completed is moved by the rollers 70, 74 of the traction assembly 49 with an intermittent advancement in the manner described above and is wound onto the takeup reel 75.

The described apparatus therefore achieves the intended aim and objects. In particular, it is noted that any differences in the advancement of the band 17 due to the continuous traction performed by the punching device 18, with respect to the intermittent traction performed by the traction assembly 49, are absorbed effectively by the elasticity of the textile material of which the band 17 is made. In any case, the punching device can be controlled kinematically by the traction assembly in order to ensure constant advancement of the band 17.

The described invention is susceptible of numerous modifications and variations, all of which are within the scope of the appended claims.

The disclosures in Italian Patent Application No. BO2007A000061 from which this application claims priority are incorporated herein by reference.

What is claimed is:

1. An apparatus for manufacturing multilayer perimetric mattress bands, comprising, supported on a main frame thereof:

first feeder means for feeding two ribbon fabrics and an intermediate tape interposed between said two ribbon fabrics to form a single three-layer band made of textile material of said fabrics and of said intermediate tape and to feed said band along a feeding direction;

a punching device which is arranged downstream of said first feeder means and is adapted to form slots in said band;

second feeder means for feeding a strip of textile material which are arranged downstream of said punching device and are adapted to arrange said strip so as to cover said slots in said band;

a sewing apparatus which is arranged downstream of said second feeder means and is adapted to fix, by way of stitched seams, said strip onto said band so as to cover said slots and to provide a multilayer article; and a traction assembly which is arranged downstream of said sewing apparatus in order to actuate advancement of said article through said sewing apparatus.

2. An apparatus for manufacturing multilayer articles, comprising, supported on a main frame thereof: first feeder means for feeding a band made of textile material along a feeding direction; a punching device which is arranged downstream of said first feeder means and is adapted to form slots in said band; second feeder means for feeding a strip of textile material which are arranged downstream of said punching device and are adapted to arrange said strip so as to cover said slots; a sewing apparatus which is arranged downstream of said second feeder means and is adapted to fix, by way of stitched seams, said strip onto said band so as to cover said slots and to provide a multilayer article; and a traction assembly which is arranged downstream of said sewing apparatus in order to actuate advancement of said article through said sewing apparatus, said punching device comprising two contrarotating rollers, which are arranged downstream of said first feeder means and are provided with respective blanking punches, between which said band is conveyed, said punches being arranged so as to cooperate with each other in order to form slots in said band.

3. The apparatus of claim 2, wherein said sewing apparatus is provided with a bar of needles, which are adapted to join a breathable strip on said band so as to cover said slots.

4. The apparatus of claim 3, comprising a plate arranged upstream of said needles for forming tucked regions along respective edges of said strip.

5. The apparatus of claim 3, wherein said traction assembly comprises a pair of contrarotating rollers, which are actuated by an intermittent mechanism.

6. The apparatus of claim 5, wherein said intermittent mechanism comprises: an eccentric element, which is actuated with a continuous rotary motion; a radial arm connected to said eccentric element; a shaft to which said radial arm is keyed radially so as to impart an oscillating motion to said arm; a pulley being rotationally rigidly coupled on said shaft and being connected to one of said contrarotating rollers by a belt drive.

7. The apparatus of claim 5, wherein said traction assembly actuated by said intermittent mechanism is synchronized with said sewing apparatus, whereby advancement movements of the band performed by said contrarotating rollers occur when the needles are disengaged from the band.

* * * * *